US007933527B2

(12) United States Patent
Yamauchi et al.

(10) Patent No.: US 7,933,527 B2
(45) Date of Patent: Apr. 26, 2011

(54) IMAGE FORMING APPARATUS, IMAGE FORMING METHOD, AND TRANSFER DEVICE

(75) Inventors: Hirokazu Yamauchi, Uji (JP); Toshiki Takiguchi, Yamatokoriyama (JP); Hiroyuki Murai, Yamatokoriyama (JP); Kazuhiro Matsuyama, Ikoma (JP); Masato Kuze, Yamatokoriyama (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 727 days.

(21) Appl. No.: 11/875,753

(22) Filed: Oct. 19, 2007

(65) Prior Publication Data

US 2009/0003895 A1 Jan. 1, 2009

(30) Foreign Application Priority Data

Oct. 23, 2006 (JP) ..... 2006-288058

(51) Int. Cl.
*G03G 15/00* (2006.01)

(52) U.S. Cl. ..... 399/45

(58) Field of Classification Search ..... 399/45
See application file for complete search history.

(56) References Cited

U.S. PATENT DOCUMENTS 3,984,183 A * 10/1976 Maksymiak ..... 399/313
5,502,545 A 3/1996 Tsuruoka
6,173,150 B1 * 1/2001 Suzuki et al. ..... 399/315
6,205,299 B1 * 3/2001 Kusaka et al. ..... 399/45
2005/0041989 A1 * 2/2005 Ohtani et al. ..... 399/45
2007/0048033 A1 * 3/2007 Soures et al. ..... 399/315

FOREIGN PATENT DOCUMENTS

JP A 7-230223 8/1995
JP 7-309479 A 11/1995
JP 10-240032 A 9/1998
JP A 11-190945 7/1999

* cited by examiner

*Primary Examiner* — David M Gray
*Assistant Examiner* — Andrew V Do
(74) *Attorney, Agent, or Firm* — Birch, Stewart, Kolasch & Birch, LLP

(57) ABSTRACT

In an image forming apparatus, an electrostatic latent image formed on a surface of a photoreceptor is developed into a toner image. A printing paper transported on a transport belt is brought into contact with the surface of the photoreceptor and an electric field is applied to the printing paper from a rear surface of the transport belt by a transfer roller to transfer the toner image onto the printing paper. The transfer roller applies different levels of electric field to the printing paper, so that a predetermined transfer electric field is applied to a region other than a leading edge of the printing paper being transported. An electric field weaker than the predetermined transfer electric field is applied to the leading edge. Even in the presence of a projection generated when the printing paper is cut, the printing paper naturally strips off from the surface of the photoreceptor.

4 Claims, 13 Drawing Sheets

THIN PAPER

REGULAR PAPER

THICK PAPER

IMAGE FORMING APPARATUS, IMAGE FORMING METHOD, AND TRANSFER DEVICE

This Nonprovisional application claims priority under U.S.C. §119(a) on Patent Application No. 288058/2006 filed in Japan on Oct. 23, 2006, the entire contents of which are hereby incorporated by reference.

FIELD OF THE INVENTION

The present invention relates to an image forming apparatus operable to perform a transfer step in which a toner image formed on a photoreceptor is transferred onto a printing paper. The invention also relates to an image forming method, and a transfer device.

BACKGROUND OF THE INVENTION

In image forming apparatuses such as copying machines and printers, the processing speed constitutes an important factor that determines the performance of the apparatus. In this regard, developments have been made to meet the demand for faster processing speed. For example, the print processing capability of "high-speed machines" has rapidly increased to 100 to 120 sheets/minute (A4-size paper, lateral feed) as compared with 50 to 70 sheets/minute (A4-size paper, lateral feed) only a few years ago. Under these circumstances, the applicable areas of such high-speed machines, from the standpoint of processing speed, now include near-printing, outside the domain of the image forming apparatus. It is therefore necessary in such high-speed image forming apparatuses to stably transport printing paper at high speed while ensuring good print quality.

In conventional image forming apparatuses, the transfer belt system has been pervasive as the system suited for high-speed processing. In image forming apparatuses adapting the transfer belt system, a printing paper electrostatically attracted to a surface of a transfer belt is transported so that a toner image formed on a surface of a photoreceptor is transferred onto the printing paper, as described in Patent Publication 1. The printing paper on the transfer belt is then sent to a fixing device, where the toner image on the printing paper is fixed thereon.

Patent Publication 1: Japanese Laid-Open Patent Publication No. 309479/1995 (Tokukaihei 7-309479, published on Nov. 28, 1995)

In a transfer step in which the toner image on the surface of the photoreceptor is transferred to the printing paper, the printing paper easily sticks to the surface of the photoreceptor and winds around the photoreceptor. This is caused by the charge on the printing paper, which is generated by the friction with various rollers transporting the printing paper, or by the transfer electric field which accumulates on the printing paper in the transfer step, among other things.

As a countermeasure, the image forming apparatus is provided with a stripping claw that forcibly strips the printing paper from the surface of the photoreceptor. In this way, a paper jam is prevented that occurs around the photoreceptor when the printing paper does not naturally strips from the surface of the photoreceptor.

Meanwhile, the image forming apparatus is designed so that the printing paper naturally strips from the surface of the photoreceptor, not forcibly with the stripping claw, taking into account such factors as the tendency of the charged printing paper to wind around the surface of the photoreceptor, the stiffness of the printing paper, the curvature of the photoreceptor, and the transport speed of the printing paper, for example. This is to prevent the stripping claw from contaminating a leading edge of the printing paper.

Specifically, in order to strip the printing paper from the surface of the photoreceptor, the stripping claw is disposed with its front end in contact with the surface of the photoreceptor. Owning to this configuration, the toner remaining on the surface of the photoreceptor easily adheres to the front end of the stripping claw. When the leading edge of printing paper is brought into contact with the front end of the stripping claw, the toner adhering to the stripping claw adheres to the leading edge of printing paper and contaminates the printing paper. Such contamination at the leading edge of the printing paper caused by the contact with the stripping claw can be avoided by naturally stripping the printing paper from the surface of the photoreceptor, before the printing paper reaches the stripping claw. The stripping claw is therefore provided as assisting means for forcibly stripping the printing paper from the surface of the photoreceptor, when the printing paper does not naturally strips.

However, despite the design that allows the printing paper to naturally strips from the surface of the photoreceptor, toner contamination occurs frequently by the contact between the leading edge of the printing paper and the stripping claw. This leads to deterioration of printed image quality as seen in conventional image forming apparatuses.

SUMMARY OF THE INVENTION

It is accordingly an object of the present invention to provide an image forming apparatus, an image forming method, and a transfer device, that enable the printing paper to be naturally stripped off from the surface of the photoreceptor without relying on the stripping claw, and that therefore prevent toner contamination caused by the contact between the leading edge of the printing paper and the stripping claw.

The inventors of the present invention made an assessment as to the cause of toner contamination that occurs at the leading edge of many printing papers when the printing paper does not naturally strips off from the surface of the photoreceptor as intended by the design that takes into account the tendency of charged printing paper to wind around the surface of the photoreceptor, the stiffness of the printing paper, the curvature of the photoreceptor, and the transport speed of the printing paper, etc. After extensive study, the inventors found what was causing toner contamination at the leading edge of many printing papers, and the solution to this problem.

Specifically, the printing papers used for the image forming apparatus are made out of a large sheet of printing paper manufactured in a paper factory, where the large sheet is cut into sheets of various standard sizes with cutters before they are packaged and shipped. The printing papers of various standard sizes therefore have cutting surfaces (edges) where projections are formed in the direction of cut.

For example, in a paper factory, a large sheet of printing paper is first cut into strips of a specific width (length), and each strip of printing paper is cut into printing papers of a specific length (width) with a vertically moving cutter. The vertically moving cutter is generally single-edged, and in this case the projection occurs only on one side of the printing paper. When the vertically moving cutter is double-edged, the projection occurs on both sides of the printing paper. The projection is small but the presence or absence or the direction of the projection can be recognized by touching it with a finger.

When the printing paper stored in a paper feeding section (paper feed cassette) of the image forming apparatus and transported therefrom between a transport belt and the photoreceptor has the projection at the leading edge, a gap is created between the leading edge of the printing paper and the transport belt, if the projection faces the transport belt.

In this case, a continuous discharge occurs between the leading edge of the printing paper and the transport belt according to Paschen's law. As a result, the potential on the transport belt side of the printing paper decreases, and this is accompanied by a relative potential increase on the photoreceptor side of the printing paper. This increases the attracting force between the printing paper and the photoreceptor, relative to that between the printing paper and the transport belt. In this case, the printing paper will not naturally strip from the surface of the photoreceptor and remains adhered to the surface of the photoreceptor. This necessitates the stripping claw to forcibly strip the printing paper from the surface of the photoreceptor, with the result that toner contamination occurs at the leading edge of the printing paper. It is therefore necessary that no gap be formed between the leading edge of the printing paper and the transport belt.

The present invention provides the following arrangements in order to prevent toner contamination that occurs when the printing paper does not naturally strip from the surface of the photoreceptor by the presence of the projection and the stripping claw is brought into contact with the leading edge of printing paper.

Specifically, in order to achieve the foregoing object, the present invention provides an image forming apparatus in which an electrostatic latent image formed on a surface of a photoreceptor is developed into a toner image with a developing device, and in which a printing paper transported on a transport belt is brought into contact with the surface of the photoreceptor and an electric field is applied to the printing paper from a rear surface of the transport belt by a transfer roller so as to transfer the toner image onto the printing paper, the transfer roller capable of applying different levels of electric field to the printing paper, so that a predetermined transfer electric field is applied to a region other than a leading edge of the printing paper being transported, and that a weak electric field weaker than the predetermined transfer electric field is applied to the leading edge of the printing paper being transported.

By weakening the transfer electric field applied to the leading edge of the printing paper, the attraction force between the printing paper and the photoreceptor can be reduced at the leading edge.

When the photoreceptor rotates, this causes a continuous discharge according to Paschen's law between the leading edge of the printing paper and the photoreceptor, even when the projection is present at the leading edge of the printing paper and when it creates a gap between the transfer belt and the leading edge of the printing paper. As a result, ease of stripping of the printing paper from the photoreceptor is improved, and toner contamination at the leading edge of the printing paper can be effectively prevented.

According to the foregoing arrangement of an image forming apparatus of the present invention, it is possible to realize an image forming apparatus, an image forming method, and a transfer device in which the printing paper naturally strips off from the surface of the photoreceptor without the aid of the stripping claw, and in which toner contamination caused by the stripping claw in contact with the leading edge of the printing paper can be prevented.

In order to achieve the foregoing object, the present invention provides a transfer device in which a printing paper transported on a transport belt is brought into contact with a surface of a photoreceptor and an electric field is applied to the printing paper from a rear surface of the transport belt by a transfer roller so as to transfer a toner image formed on the surface of the photoreceptor onto the printing paper, the transfer roller capable of applying different levels of electric field to the printing paper, so that a predetermined transfer electric field is applied to a region other than a leading edge of the printing paper being transported, and that a weak electric field weaker than the predetermined transfer electric field is applied to the leading edge of the printing paper being transported.

In order to achieve the foregoing object, the present invention provides an image forming method in which an electrostatic latent image formed on a surface of a photoreceptor is developed into a toner image with a developer, and in which a printing paper transported on a transport belt is brought into contact with the surface of the photoreceptor and an electric field is applied to the printing paper from a rear surface of the transport belt by a transfer roller so as to transfer the toner image onto the printing paper, the method including weakening an electric field that is applied to a leading edge of the printing paper being transported, relative to an electric field applied to a region of the printing paper other than the leading edge.

By installing a transfer device of the present invention in an image forming apparatus, and by applying an image forming method of the present invention to an image forming apparatus, it is possible to obtain the effects described as effects of an image forming apparatus of the present invention.

Additional objects, features, and strengths of the present invention will be made clear by the description below. Further, the advantages of the present invention will be evident from the following explanation in reference to the drawings.

BRIEF DESCRIPTION OF THE DRAWINGS

FIG. 6(*b*) is a perspective view of a step in which each rolled paper is cut into printing papers of a specific size; and FIG. 6(*c*) is an explanatory diagram showing a step in which the printing papers of a specific size are gathered at one place.

FIG. 7(*b*) is a longitudinal section showing how a projection is generated at an edge of the printing paper cut with the second cutter.

DETAILED DESCRIPTION OF THE INVENTION

The present invention is applicable to an arrangement, such as a transfer unit realized by a photoreceptor and a transfer belt in an image forming apparatus, that is adapted to transport a printing paper so as to avoid adverse effects of a projection that is formed on the printing paper as a result of cutting the printing paper.

One embodiment of the present invention is described below with reference to FIGS. 1 to 15. It should be appreciated that the present invention is not limited by the following description.

The following will describe one embodiment of the present invention with reference to the attached drawings.

Figure 2:
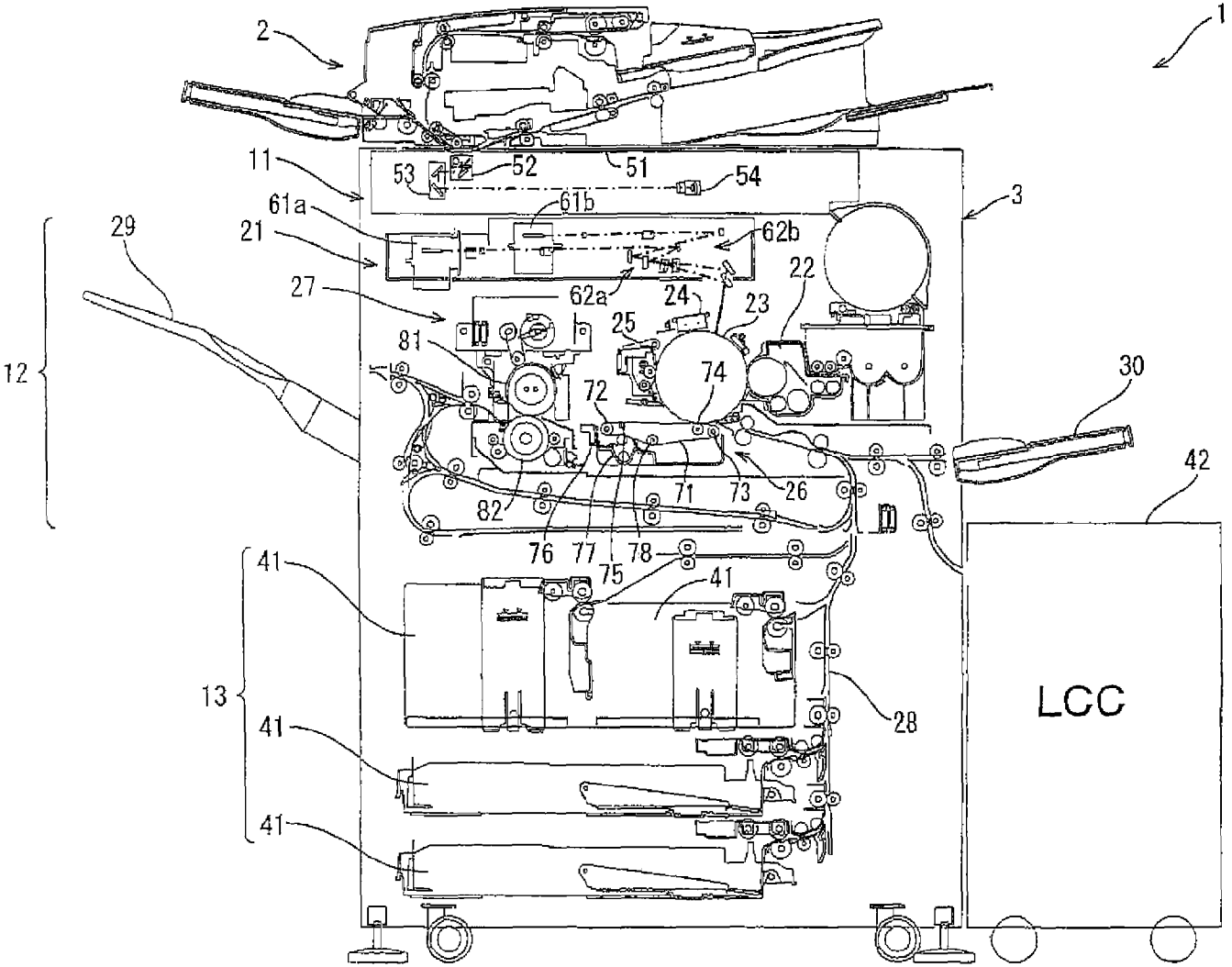
FIG. 2 is an explanatory diagram schematizing a whole structure of a multi-functional apparatus provided with the image forming apparatus according to one embodiment of the present invention.

FIG. 2 is an explanatory diagram schematically showing a whole structure of a multi-functional apparatus 1 provided with an image forming apparatus of the present embodiment. The multi-functional apparatus 1 includes a document feeder (hereinafter, "SPF": Single Pass Feeder) 2, and an image forming apparatus 3.

The image forming apparatus 3 forms a monochromatic image on a printing paper (sheet) according to image data obtained by scanning a document that has been transported with the SPF 2, or externally inputted image data. The image forming apparatus 3 includes a scanner section (document reading device) 11, a printer section 12, and a paper feeding section 13.

The printer section 12 includes an optical write-in unit 21, a developing unit 22, a photoreceptor 23, a charger 24, a cleaner unit 25, a transfer unit 26, a fixing unit 27, a paper transport path 28, an eject tray 29, and a manual feed tray 30. The paper feeding section 13 includes paper feed cassettes 41 and a large-capacity paper feed cassette (LCC) 42. The paper feed cassettes 41 and the large-capacity paper feed cassette 42 store printing papers to be used for image formation.

The scanner section 11 on its upper portion includes a document platen 51 made of glass, below which a light-source holder 52, a set of mirrors 53, and a CCD (imaging device) 54 are provided. In scanning a document sent from the SPF 2, the scanner section 111 holds the light-source holder 52 and the set of mirrors 53 at one end of the document platen 51. In response to the document from the SPF 1, a light source of the light-source holder 52 projects light on the document, and the reflected light from the document is converged via the set of mirrors 53 on the COD 54, which then converts the light into electrical image data. For this operation, a scan window is formed at one end on the upper surface of the scanner section 11. In the printer section 12, the charger 24 uniformly charges a surface of the photoreceptor 23 to a predetermined potential. The image forming apparatus 3 uses the charger 24 of an electrostatic charging type, but the charge 24 may be of a contact roller-type or a contact brush-type.

To accommodate the high-speed print process, the optical write-in unit 21 employs a two-beam method using two laser irradiating sections 61*a* and 61*b*, which case the burden of short irradiation timings. The optical write-in unit 21 causes the laser irradiating sections 61*a* and 61*b* to emit laser beams according to inputted image data. Via a set of mirrors 62*a* and 62*b*, the laser beams irradiate and expose the photoreceptor 23 that has been uniformly charged. As a result, an electrostatic latent image according to the image data is formed on the surface of the photoreceptor 23.

In the image forming apparatus 3, the optical write-in unit 21 is realized by a laser scanning unit (LSU) equipped with the laser irradiating sections 61*a*, 61*b* and the set of mirrors 62*a* and 62*b*. However, an EL or LED write head may be used in which light-emitting elements are disposed in an array.

The developing unit 22 is disposed to face the photoreceptor 23, and visualizes the electrostatic latent image formed on the surface of the photoreceptor 23, using black toner. The cleaner unit 25 removes and collects toner remaining on the surface of the photoreceptor 23 after development and image transfer.

The transfer unit (transfer device) 26 applies an electric field of the polarity opposite the charge of the electrostatic latent image, so that the toner image formed on the surface of the photoreceptor 23 is transferred onto the printing paper. For example, a positive (+) electric field is applied when the electrostatic latent image is negatively charged (−). The transfer unit 26 includes a transfer belt (transport belt) 71, a driving roller 72, a driven roller 73, and a transfer roller 74. The transfer roller 74 is provided at the point of contact between the photoreceptor 23 and the transfer belt 71, and applies a transfer electric field.

The transfer belt 71 has a resistance value in a range of $1\times10^{9}$ to $1\times10^{13}$ Ω·cm. The transfer roller 74 generates the electric field of this range so that the toner image formed on the photoreceptor 23 is transferred onto the printing paper. The transfer roller 74 is formed of an elastically supported conductive roller. By being elastic, the transfer roller 74 allows the photoreceptor 23 and the transfer belt 71 to be brought into contact with each other over an area, not a line, of a predetermined width (transfer nip). This improves transfer efficiency of the toner image onto the paper.

The transfer unit 26 further includes a charge-removing roller 75, a cleaning unit 76, a charge-removing mechanism 77, and a tension roller 78. The charge-removing roller 75 is provided on the downstream side of the transfer region, so that the charge of printing paper applied by the electric field in the transfer region is removed. In this way, the printing paper can be smoothly transported to the next step. The cleaning unit 76 removes toner contamination on the transfer belt 71. The charge-removing mechanism 77 removes charge from the transfer belt 71. The charge-removing mechanism 77 may remove charge by grounding, or by actively applying an electric field of the polarity opposite the polarity of the transfer electric field. The tension roller 78 applies tension to the transfer belt 71.

The fixing unit 27 fixes the transferred toner image on the printing paper by heating and fusing it. The fixing unit 27 includes a heat roller 81 and a pressure roller 82. The heat roller 81 has a heat source installed therein, and the pressure roller 82 is pressed against the heat roller 81 with a predetermined pressure.

Printing paper with a printed image is ejected onto the eject tray 29. Instead of the eject tray 29, devices for post-processing of the ejected paper (for example, stapling, punching), or eject trays of multiple stages may be optionally provided.

The paper feed cassettes 41 and the large-capacity paper feed cassette 42 are provided to store printing papers (sheets) used for image formation. For high-speed print processes, the paper feed cassette 41 disposed below the printer section 12 can store 500 to 1500 sheets of printing paper of each standard size. The large-capacity paper feed cassette 42 disposed outside of the cabinet of the image forming apparatus 3 can store large numbers of different kinds of printing paper. The manual feed tray 30 is provided to feed printing paper of a non-standard size.

Figure 3:
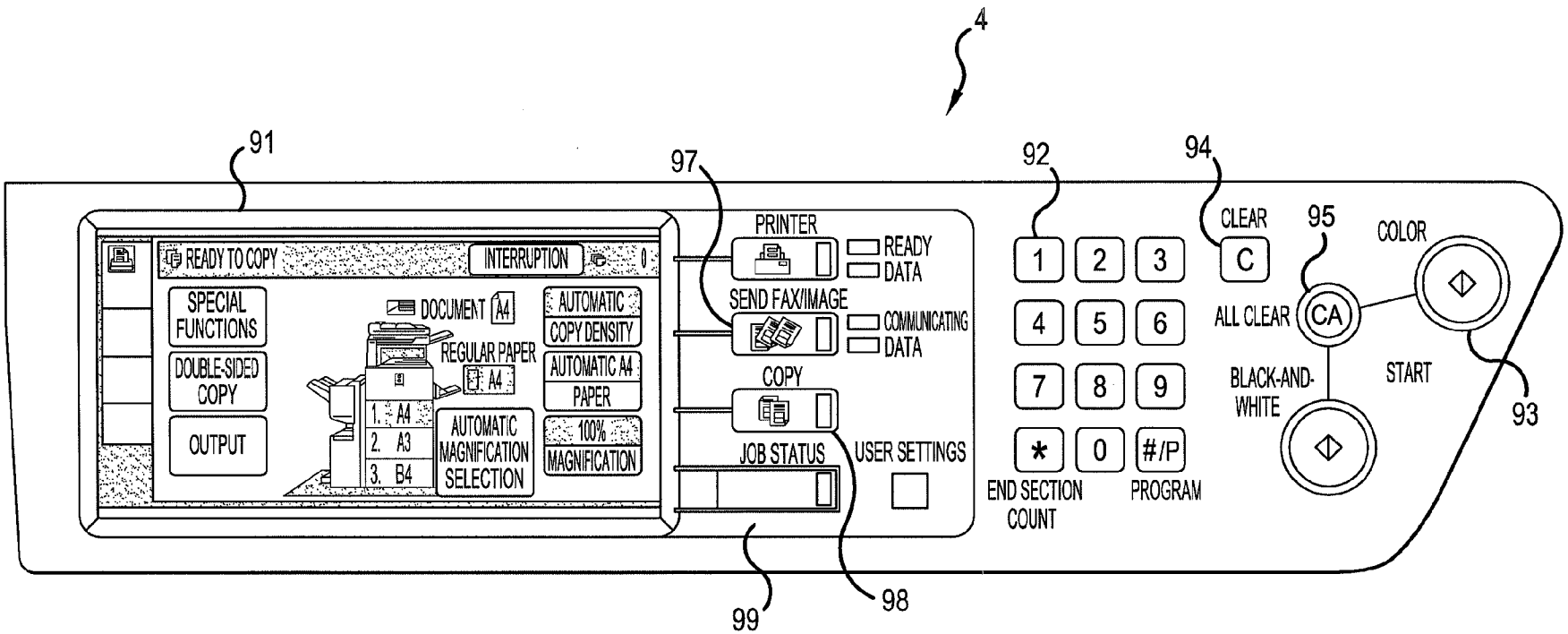
FIG. 3 is a front view of a touch-panel liquid crystal display provided in the multi-functional apparatus shown in FIG. 2.

As a user interface, the multi-functional apparatus 1 is provided with an operation panel 4. As shown in FIG. 3, the operation panel 4 includes a touch-panel liquid crystal display (hereinafter "LCD") 91 numeric keys 92, a start key 93, a clear key 94, a clear all key 95, a printer key 96, a facsimile/image send key 97, a copy key 98, and a job status confirmation key 99, among others.

In the following, description is made as to a stripping operation in the image forming apparatus 3, in which the printing paper is stripped from the photoreceptor 23 after the toner image formed on the surface of the photoreceptor 23 has been transferred onto the printing paper on the transfer belt 71.

Figure 1:
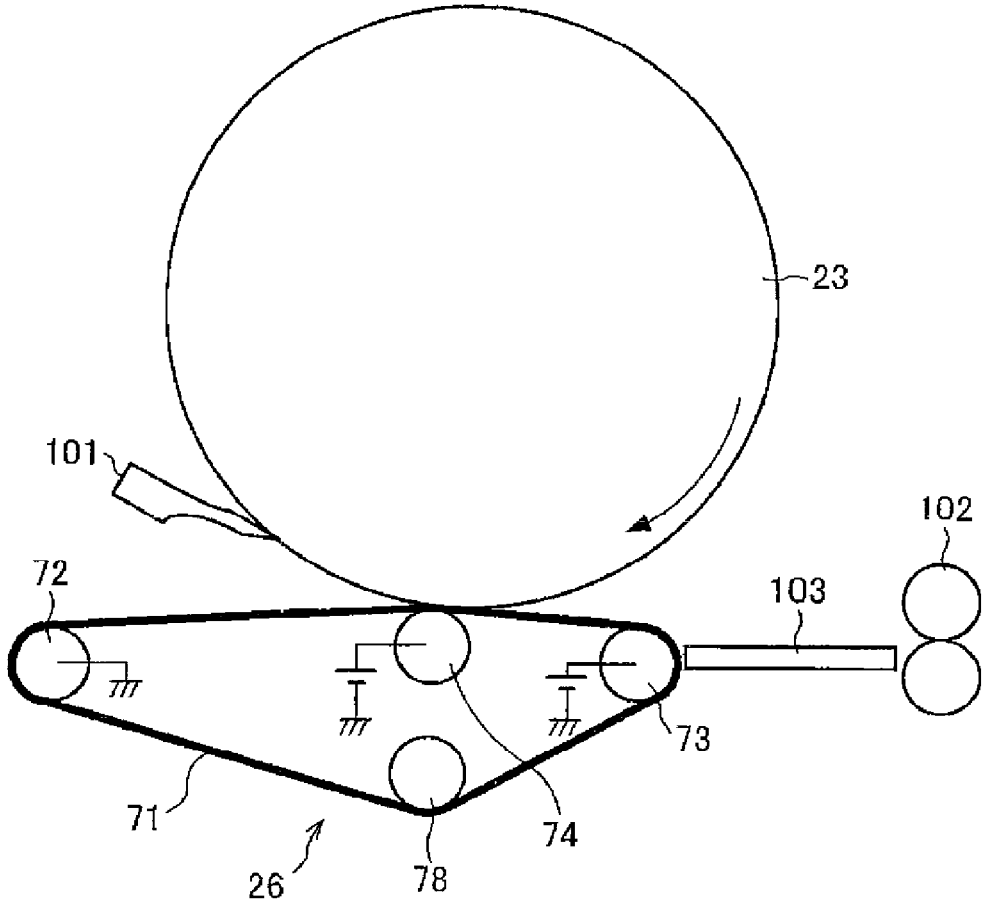
FIG. 1 is an explanatory diagram schematizing a structure of an image forming apparatus in the vicinity of a transfer unit and a photoreceptor, according to one embodiment of the present invention.

FIG. 1 is an explanatory diagram schematizing a structure in the vicinity of the transfer unit 26 and the photoreceptor 23 in the image forming apparatus 3 shown in FIG. 2. As diagramed, the driven roller 73 serves as a paper attracting roller which charges the transfer belt 71 to attract the printing paper, and the driving roller 72 serves as a paper stripping roller which removes the charge of the printing paper to facilitate stripping of the paper from the transfer belt 71. On the periphery of the photoreceptor 23, a stripping claw 101 is provided downstream of the nip area between the photoreceptor 23 and the transfer belt 71, with respect to the direction of transport of printing paper. The stripping claw 101 forcibly strips the printing paper adhering to the surface of the photoreceptor 23.

In FIG. 1, the printing paper is transported between the transfer belt 71 and the photoreceptor 23 by being carried on the transfer belt 71 of the transfer unit 26 via registration rollers 102 and a paper guide 103. The registration rollers 102 send out the paper at a predetermined timing that the toner image on the surface of the photoreceptor 23 aligns in position with the printing paper.

By the transfer electric field applied by the transfer roller 74, the toner image on the surface of the photoreceptor 23 is transferred onto the printing paper that has been transported to the nip area between the transfer belt 71 and the photoreceptor 23. By virtue of the charge generated by friction or electric field during transport, the printing paper has the tendency to wind around the surface of the photoreceptor 23. However, it is intended by design that the printing paper is naturally stripped before the leading edge of the paper reaches the stripping claw 101, taking into account influences of such factors as stiffness of printing paper, curvature of the photoreceptor, and transport speed of printing paper, or attracting electric field of the transfer belt 71.

Figure 4:
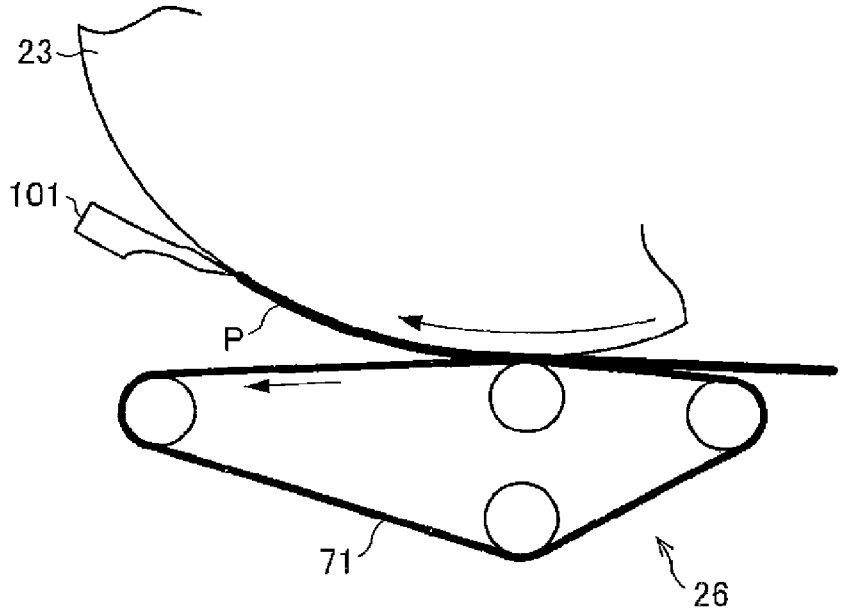
FIG. 4 is an explanatory diagram illustrating how a printing paper is forcibly stripped from a surface of the photoreceptor with a stripping claw, when the printing paper does not naturally strips in the arrangement shown in FIG. 1.
Figure 5:
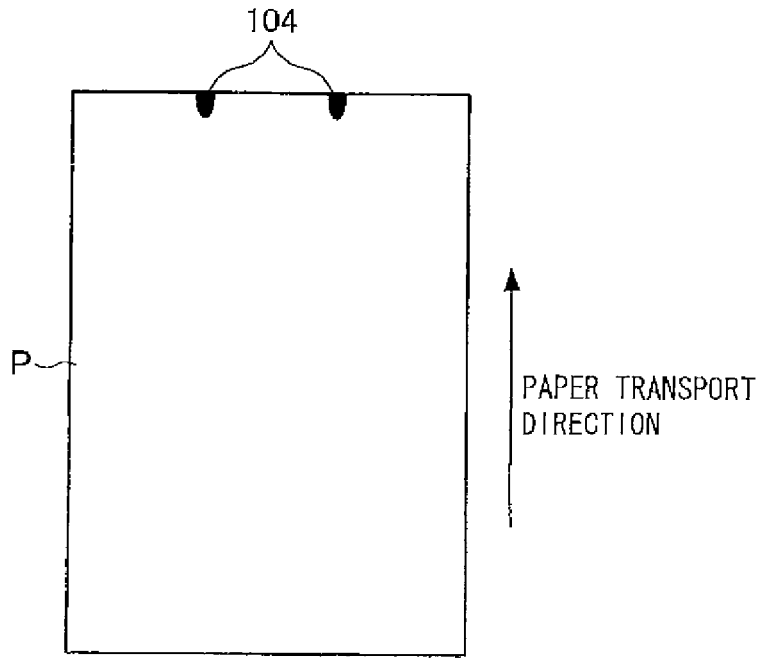
FIG. 5 is a front view of printing paper on which toner contamination has occurred at the leading edge by the forced stripping with the stripping claw shown in FIG. 4.

However, despite such design, the printing paper in actual practice does not always behave as intended. In some cases, the printing paper is naturally stripped from the surface of the photoreceptor 23. In other cases, as shown in FIG. 4, the printing paper does not strip naturally but the leading edge of printing paper P reaches the stripping claw 101 and is forcibly stripped. When forcibly stripped by the stripping claw 101, the toner adhering to the stripping claw 101 is transferred to the leading edge of printing paper P and causes toner contamination 104, as shown in FIG. 5.

To investigate, occurrence of toner contamination 104 on printing paper was examined. As a result, certain patterns were observed in toner contamination 104 occurring in printing papers obtained from the same package. Table 1 below shows the result of investigation. In Table 1, Feed Example 1 and Feed Example 2 represent sheets of paper produced by different manufacturers. The papers in each example came from the same package

TABLE 1

| Continuously Printed Papers | Feed Example 1 | Feed Example 2 |
|---|---|---|
| 1st paper | ○ | ○ |
| 2nd paper | ○ | x |
| 3rd paper | ○ | x |
| 4th paper | x | x |
| 5th paper | x | ○ |
| 6th paper | ○ | ○ |
| 7th paper | ○ | x |
| 8th paper | ○ | x |
| 9th paper | x | x |
| 10th paper | x | ○ |
| 11th paper | ○ | ○ |
| 12th paper | ○ | x |
| . | . | . |
| . | . | . |
| . | . | . |

○: No contamination; x: Contamination

Contamination at the leading edge of paper occurred according to the order of the papers loaded in a storage pack.

As can be seen from Table 1, Feed Example 1 followed the pattern that contamination occurred in the fourth and fifth printing papers and in subsequent two consecutive printing papers that occurred after every three printing papers. Feed Example 2 followed the pattern that contamination occurred in the second, third, and fourth printing papers and in subsequent three consecutive printing papers that occurred after every two printing papers.

Then, comparisons were made between contaminated printing papers and non-contaminated printing papers. It was found as a result that the presence or absence of contamination was attributed to the direction of the projection on the cutting surface (edge) of the printing paper, and the direction of transport of the printing paper. The following describes this in detail.

Figure 6:
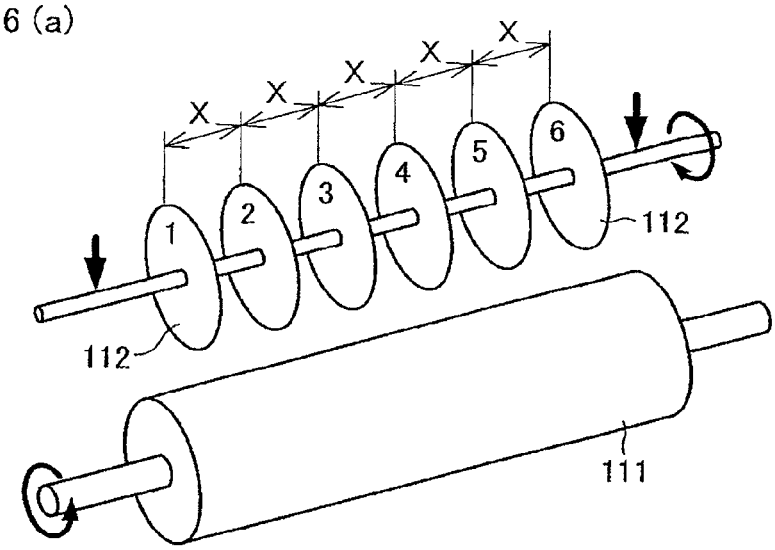
FIG. 6(*a*) is a perspective view of a step of cutting a rolled paper into printing papers of a specific size, illustrating how the rolled paper is cut into a plurality of roller papers of a specific width.
Figure 6:
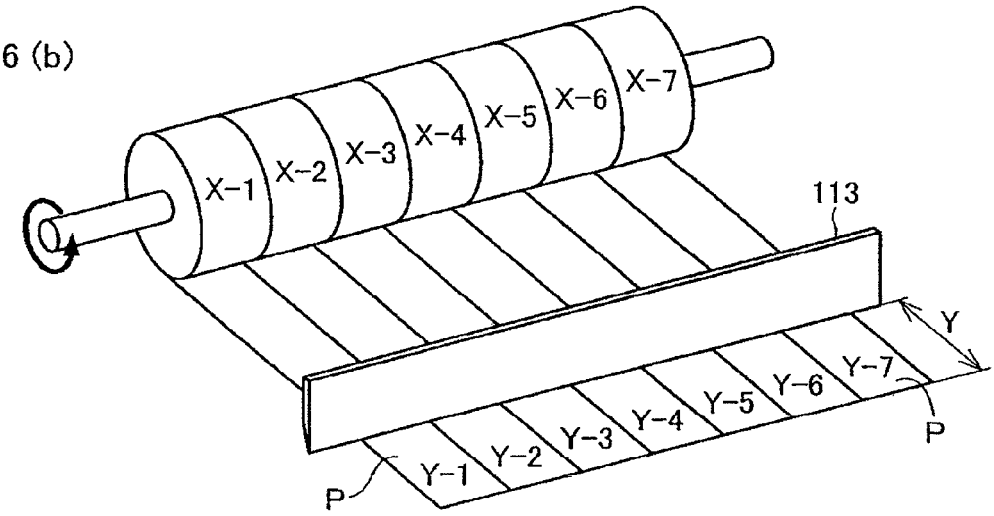
Figure 6:
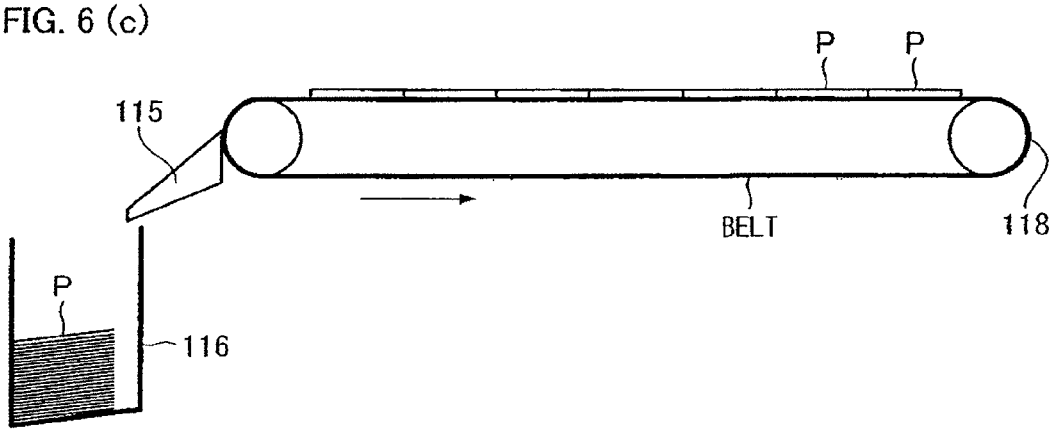

First, description is made as to how the projection is generated in a cutting step in the manufacture of the printing papers. FIG. 6 represents a step in which a large printing paper (a roil of paper) that has been produced in advance is cut into printing papers of a specific size. FIG. 6(*a*) is a perspective view showing a step in which a roll of paper is cut into smaller rolls of a specific width. FIG. 6(*b*) is a perspective view showing a step in which each roll of paper is cut into printing papers of a specific size. FIG. 6(*c*) is an explanatory diagram representing a step in which the printing papers of a specific size are organized and stacked together.

As shown in FIG. 6(*a*), a long and wide rolled paper 111 is cut into rolls of a specific width (or length) with a multiplicity of first cutters 112. As the first cutters 112, circular diamond cutters are used that rotate to cut the paper, for example. Next, as shown in FIG. 6(*b*), the rolls of paper are simultaneously cut into papers of a specific length (or width) with a single second cutter 113. As the second cutter 113, a guillotine cutter is used, for example. Printing paper P of a specific size is then transported in one direction by the transport belt 118, and stacked on a paper stack section 116 by being guided with a paper navigating board 115. The printing papers in the paper stack section 116 are then packed into 500-sheet packages, for example.

Figure 7:
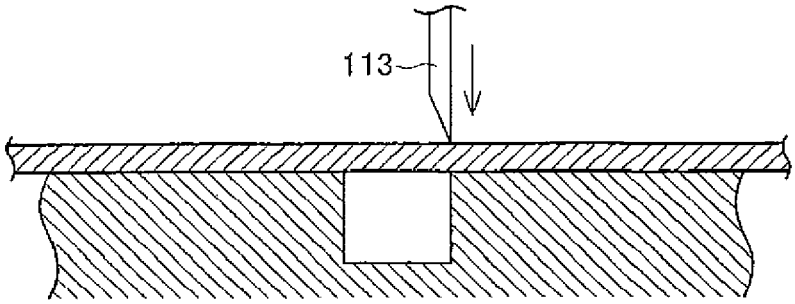
FIG. 7(*a*) is a longitudinal section showing a step in which a printing paper is cut with a second cutter shown in FIG. 6(*b*)
Figure 7:
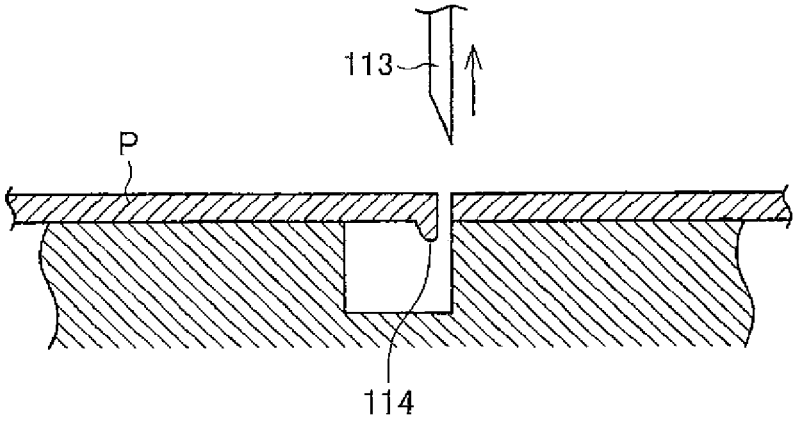
Figure 8:
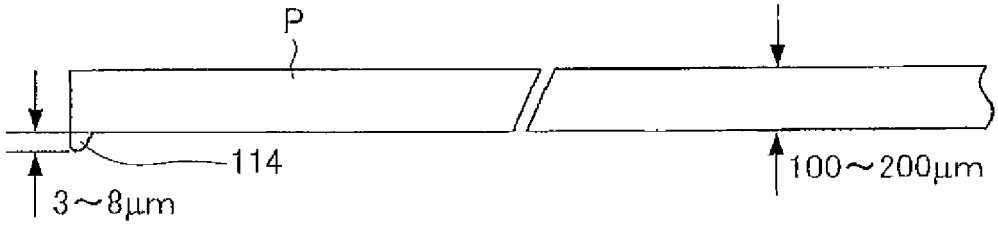
FIG. 8 is an explanatory diagram representing examples of dimensions for a thickness of the printing paper and a size of the projection shown in FIG. 7(*b*).

Here, when the first cutters 112 and the second cutter 113 are used to cut the printing paper, projections are generated, though to different extent, on the surface (edge) of the paper in the direction the paper is cut. FIG. 7 illustrates this. FIG. 7(*a*) is a longitudinal section showing a step in which the printing paper is cut with the second cutter 113, for example. FIG. 7(*b*) is a longitudinal section showing a state in which a projection 114 is generated at the edge of printing paper cut with the second cutter 113. The projection 114 shown in FIG. 7(*b*) has a height of, for example, 3 μm to 8 μm, when the printing paper P has a thickness of 100 μm to 200 μm, as shown in FIG. 8. The projection 114 is small flow) when the first cutters 112 and the second cutter 113 are sharp (desirable), and is large (high) when the first cutters 112 and the second cutter 113 are blunt.

The following will describe how the direction of transport of printing paper is related to the success and failure of natural stripping. Note that, the direction of transport of printing paper takes into account the position and direction of the projection 114.

Figure 9:
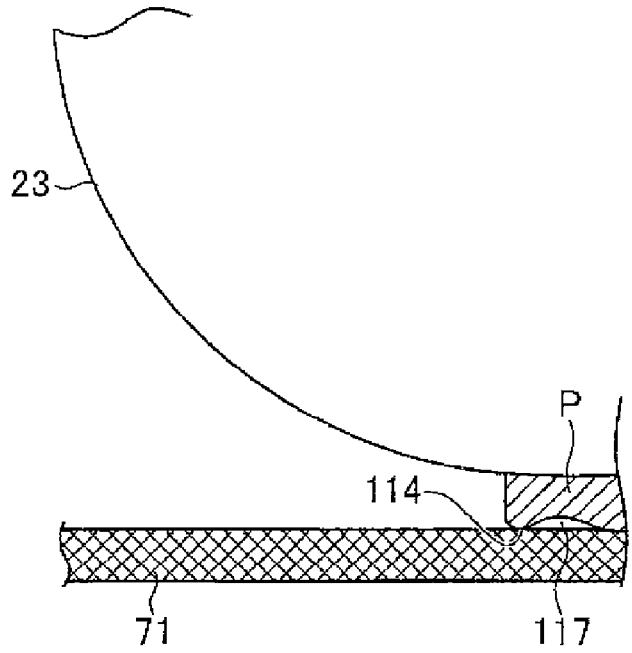
FIGS. 9(*a*) and 9(*b*) are explanatory diagrams illustrating how the printing paper is striped from the surface of the photoreceptor when the printing paper is transported with the projection of FIG. 8 formed at the leading edge in the direction of transport of the printing paper and facing the transfer belt.
Figure 9:
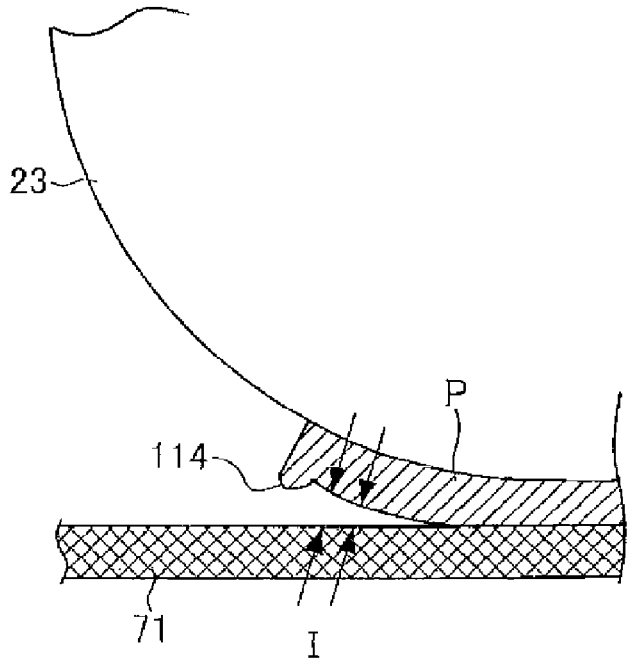

FIGS. 9(*a*) and 9(*b*) are explanatory diagrams showing how the printing paper P is stripped from the surface of the photoreceptor 23 when the projection 114 of the printing paper P is at the leading edge of the printing paper P being transported and when the projection 114 directs downward (faces the transfer belt 71).

When the printing paper P is transported in the direction shown in FIGS. 9(*a*) and 9(*b*), the upper surface of the printing paper P will be in contact with the surface of the photoreceptor 23 at the leading edge emerging from the transfer nip, whereas the lower surface of the printing paper P is separated from the transfer belt 71 at the leading edge by a gap 117, which is created by the projection 114 at the leading edge of the printing paper P. When the photoreceptor 23 rotates, as shown in FIG. 9(*b*), this causes a continuous discharge (I) according to Paschen's law between the leading edge of the printing paper P and the transfer belt 71 (between opposing arrowheads at the leading edge in FIG. 9(*b*)). As a result, the potential on the transfer belt 71 side of the printing paper P decreases, and this is accompanied by a relative potential increase on the photoreceptor 23 side of the printing paper P. This increases the attracting force between the printing paper P and the photoreceptor 23, relative to that between the printing paper P and the transfer belt 71. In this case, the printing paper P will not be naturally stripped from the photoreceptor 23 and remains adhered to the surface of the photoreceptor 23. This necessitates the stripping claw 101 to forcibly strip the printing paper P from the surface of the photoreceptor 23, with the result that toner contamination 104 occurs at the leading edge.

Figure 10:
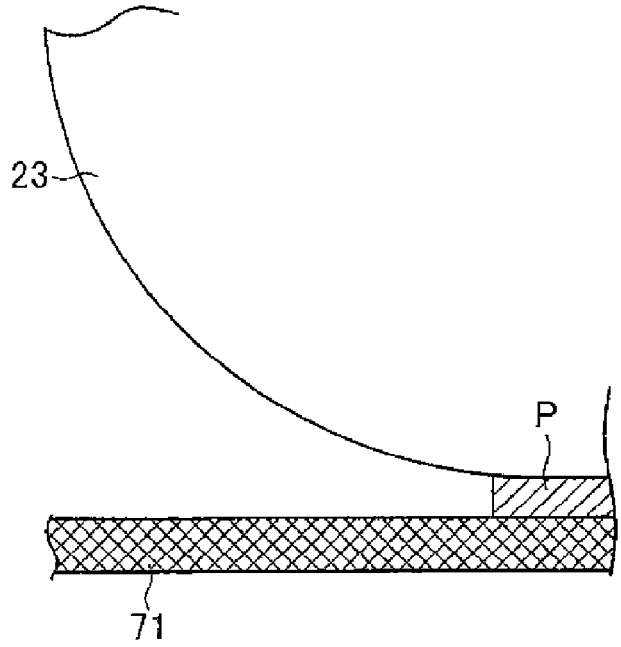
FIGS. 10(*a*) and 10(*b*) are explanatory diagrams illustrating how the printing paper is stripped from the surface of the photoreceptor when the printing paper is transported with the projection of FIG. 8 not formed at the leading edge in the direction of transport of the printing paper.
Figure 10:
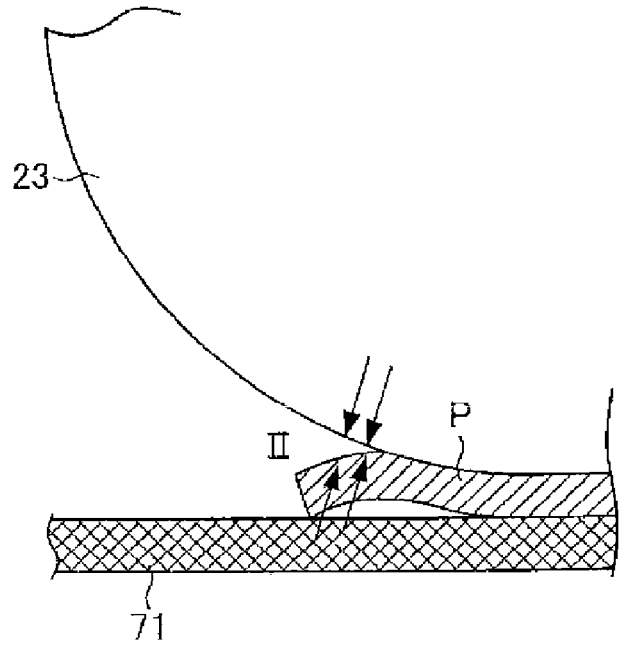

FIGS. 10(*a*) and 10(*b*) are explanatory diagrams showing how the printing paper P is stripped from the surface of the photoreceptor 23, when the printing paper P is transported in such a direction that the projection 114 is not present at the leading edge of the printing paper P with respect to the direction of transport.

When the printing paper P is transported in the direction shown in FIGS. 10(*a*) and 10(*b*), no gap 117 is present between the lower surface of the printing paper P and the transfer belt 71 at the leading edge that has come out of the transfer nip, and the lower surface of the printing paper P will be in contact with the transfer belt 71. When the photoreceptor 23 rotates, as shown in FIG. 10(*b*), this causes a continuous discharge (II) according to Paschen's law between the leading edge of the printing paper P and the photoreceptor 23 (between opposing arrowheads in FIG. 10(*b*)). As a result, the printing paper P is naturally stripped from the surface of the photoreceptor 23 by the rotation of the photoreceptor 23. There according will be no toner contamination 104 at the leading edge of the printing paper P, which occurs when the printing paper P is forcibly stripped by the stripping claw 101.

Figure 11:
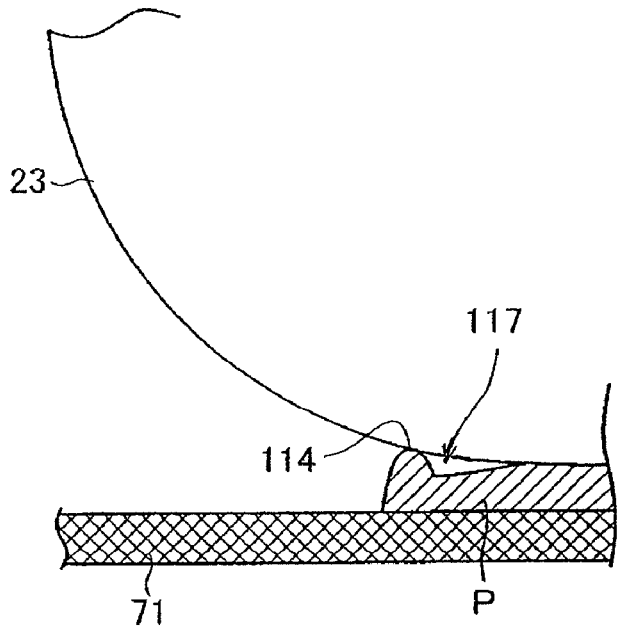
FIGS. 11(*a*) and 11(*b*) are explanatory diagrams illustrating how the printing paper is stripped from the surface of the photoreceptor when the printing paper is transported with the projection of FIG. 8 formed at the leading edge in the direction of transport of the printing paper and facing the photoreceptor.
Figure 11:
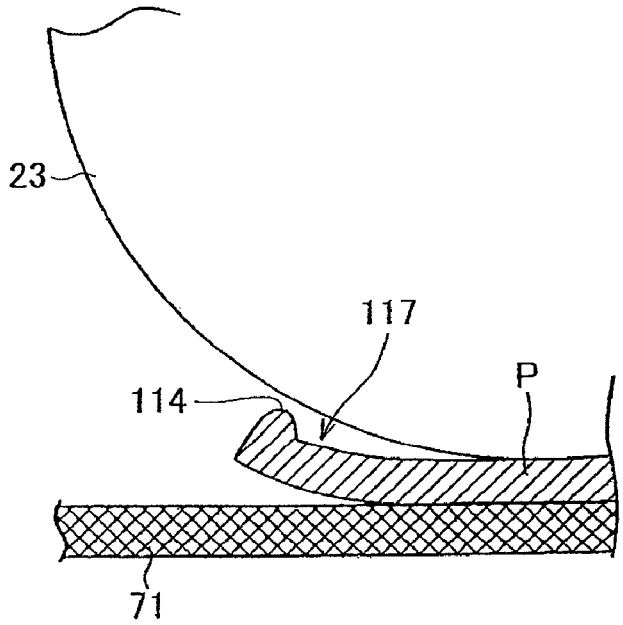

FIGS. 11(*a*) and 11(*b*) are explanatory diagrams showing how the printing paper P is stripped from the surface of the photoreceptor 23, when the printing paper P is transported in such a direction that the projection 114 is at the leading edge of the printing paper P with respect to the direction of transport and faces upward (faces the photoreceptor 23).

When the printing paper P is transported in the direction shown in FIGS. 11(*a*) and 11(*b*), the gap 117 is created by the projection 114 at the leading edge of the printing paper P. The gap separates the upper surface of the printing paper P from the surface of the photoreceptor 23 at the leading edge that has come out of the transfer nip. When the photoreceptor 23 rotates, as shown in FIG. 10(*b*), this causes a continuous discharge according to Paschen's law between the leading edge of the printing paper P and the transfer belt 71. As a result, the potential on the photoreceptor 23 side of the printing paper P decreases, and this is accompanied by a relative potential increase on the transfer belt 71 side of the printing paper P. This decreases the attracting force between the printing paper P and the photoreceptor 23. There according will be no toner contamination 104 at the leading edge of the printing paper P, which occurs when the printing paper P is forcibly stripped by the stripping claw 101. Note that, in this case, the natural stripping of the printing paper P from the surface of the photoreceptor 23 occurs more easily compared with the case shown in FIGS. 10(*a*) and 10(*b*), making it possible to more effectively preventing the toner contamination 104 at the leading edge of the printing paper P.

It can be seen from the foregoing configurations that the toner contamination 104 at the leading edge of the printing paper caused by the projection at the cutting surface (edge) of the printing paper can be prevented by transporting the printing paper in the directions shown in FIGS. 10(*a*) and 10(*b*) and FIGS. 11(*a*) and 11(*b*), that is, in such directions that the projection 114 is not present at the leading edge of the printing paper, or by transporting the printing paper in such a direction that the projection 114 is present at the leading edge of the printing paper with respect to the direction of transport of the printing paper and that the projection 114 faces the photoreceptor 23.

In other words, the toner contamination 104 can be prevented by not transporting the printing paper in the direction of transport shown in FIGS. 9(*a*) and 9(*b*), that is, by not transporting the printing paper in such a direction that the projection 114 is present at the leading edge of the printing paper with respect to the direction of transport, and that the projection 114 faces the transfer belt 71. In the following, the directions of transport that do not cause the toner contamination 104 will be referred to as "proper transport directions."

In the image forming apparatus 3 shown in FIG. 2, the printing paper can be transported in the proper transport direction by properly placing the printing papers in the paper feed cassette 41 of the paper feeding section 13 and the large-capacity paper feed cassette 42, taking into account the direction of the projection 114. Whether a side of the printing paper has the projection 114, or the direction of the projection 114 can be found by touching the side of printing paper with a finger. This is possible despite the small size of the projection 114.

The following describes results of assessment on factors that pose difficulties in natural stripping of the printing paper from the surface of the photoreceptor in a common image forming apparatus.

As described above, ease of stripping the printing paper from the surface of the photoreceptor is influenced by such factors as the stiffness of the printing paper, the curvature of the photoreceptor, and the transport speed of the printing paper, for example.

More specifically, stripping (natural stripping) is more difficult as the diameter of the photoreceptor is increased (smaller curvature) since this decreases the angle made by the printing paper and the surface of the photoreceptor at the stripping position. Stripping is also difficult when the photoreceptor has a high peripheral speed (faster transport speed of printing paper). In reversal development, a transfer electric field of the opposite polarity to the photoreceptor is applied. As such, ease of stripping suffers as the transfer electric field is increased, since the photoreceptor of the opposite polarity easily attracts the printing paper. In regard to the type of printing paper, ease of stripping suffers as the printing paper becomes less stiff.

Other factors include the environment in which the apparatus is used, and the presence or absence of image information at the leading edge of the printing paper. The printing paper is easily electrified when the temperature and moisture of the apparatus environment is low. In this case, the printing paper is easily attracted to the surface of the oppositely charged photoreceptor, which makes it difficult to strip the printing paper. In the case where the leading edge of the printing paper does not have image information and no toner adheres thereto, the potential at the leading edge remains high. This also makes it difficult to strip the printing paper.

These factors interact with one another. For example, the printing paper softens under high-temperature and high-humidity conditions, which theoretically makes it difficult to strip the printing paper. However, the printing paper can be desirably stripped even under these conditions. This is because the high temperature and high humidity make it difficult to electrify the printing paper, with the result that the printing paper is hardly attracted to the surface of the photoreceptor.

The influence of the stiffness of printing paper on ease of stripping becomes small as the peripheral speed of the photoreceptor is increased. At high peripheral speeds, the stiff printing paper is more difficult to strip compared with thin printing paper. This is because the amount of charge is greater in stiff printing paper than in thin printing paper.

The following will describe the image forming apparatus 3 of the present embodiment in more detail in regard to the structure for preventing toner contamination at the leading edge of the printing paper.

In the present embodiment, the image forming apparatus 3 is adapted so that a predetermined transfer electric field suited for transfer, applied by the transfer roller 74 via the transfer belt 71, is weaker at the leading edge of the printing paper passing through the transfer nip. More specifically, a predetermined transfer electric field suited for transfer is applied to regions other than the leading edge of the printing paper being transported, whereas a weaker transfer electric field is applied to the leading edge of the printing paper being transported.

Figure 12:
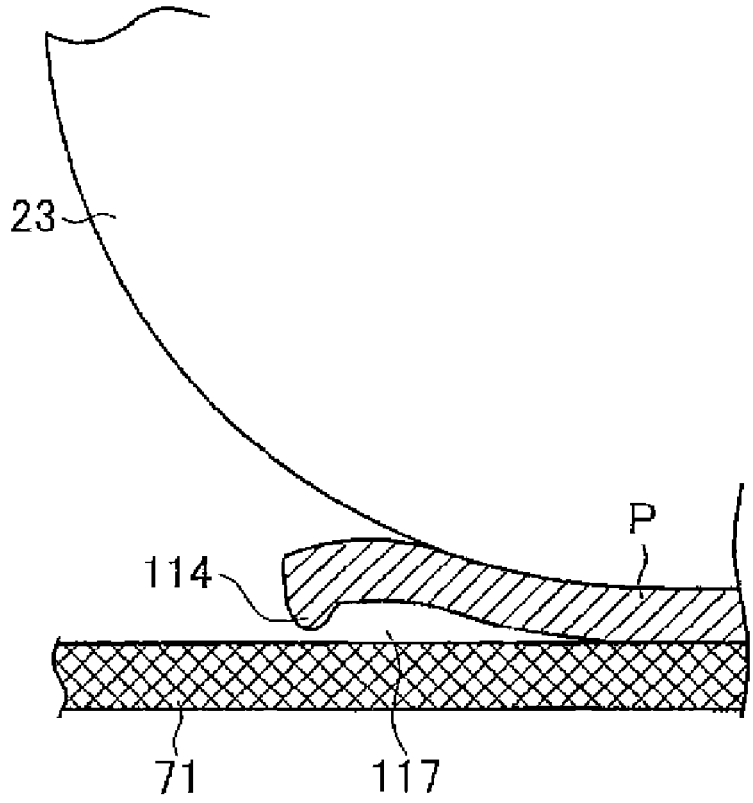
FIG. 12 is an explanatory diagram showing how the printing paper is stripped from the surface of the photoreceptor in an image forming apparatus of one embodiment of the present invention, when the printing paper is transported with the projection of FIG. 8 formed at the leading edge in the direction of transport of the printing paper and facing the transfer belt.

As described above, the intensity of transfer electric field is one factor that influences ease of stripping. As the transfer electric field is increased, the printing paper is more easily attracted to the photoreceptor. The attraction force that draws the printing paper P to the photoreceptor 23 at the leading edge can then be reduced by weakening the transfer electric field at the leading edge of the printing paper. In this way, by the rotation of the photoreceptor 23, continuous discharge occurs according to Paschen's law between the photoreceptor 23 and the leading edge of the printing paper P as shown in FIG. 12, even when the projection 114 is present at the end of the printing paper and when the projection 114 creates the gap 117 between the transport belt 71 and the leading edge of the printing paper P as shown in FIG. 9(*a*). This enables the printing paper P to be easily stripped from the photoreceptor 23, and effectively prevents the toner contamination 104 at the leading edge of the printing paper P.

Figure 13:
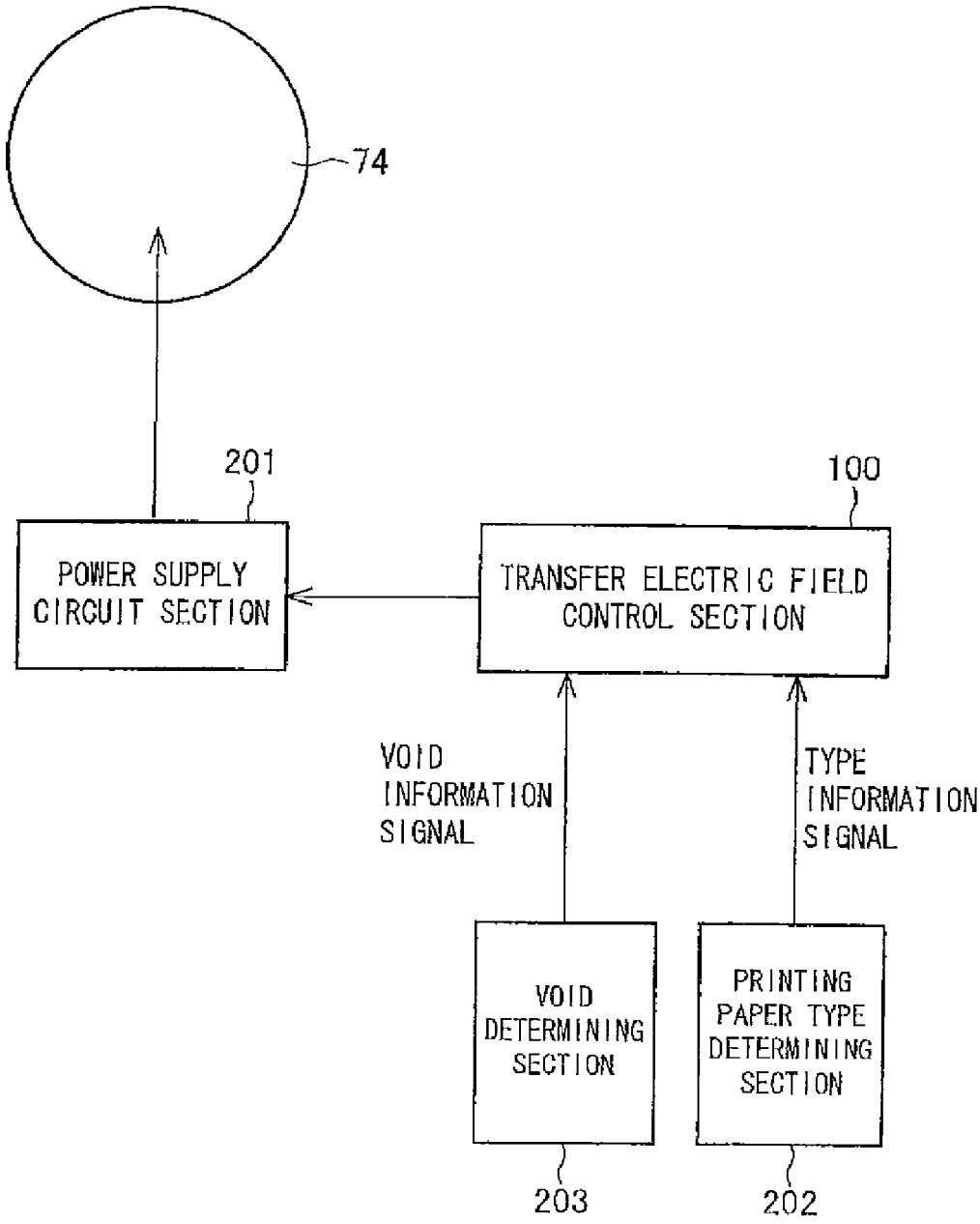
FIG. 13 is a block diagram showing an arrangement realizing multi-step switching control for the electric field applied by the transfer roller of an image forming apparatus of one embodiment of the present invention.

In order to realize such functions, as shown in FIG. 13, the transfer unit 26 includes a transfer electric field control section 100. The transfer electric field control section 100 performs two-step control for the electric field applied to the printing paper, by controlling the output voltage of a power supply circuit section 201 that supplies voltage to the transfer roller 74. The transfer electric field control section 100 is realized by, for example, CPU and associated ROM and RAM.

Figure 14:
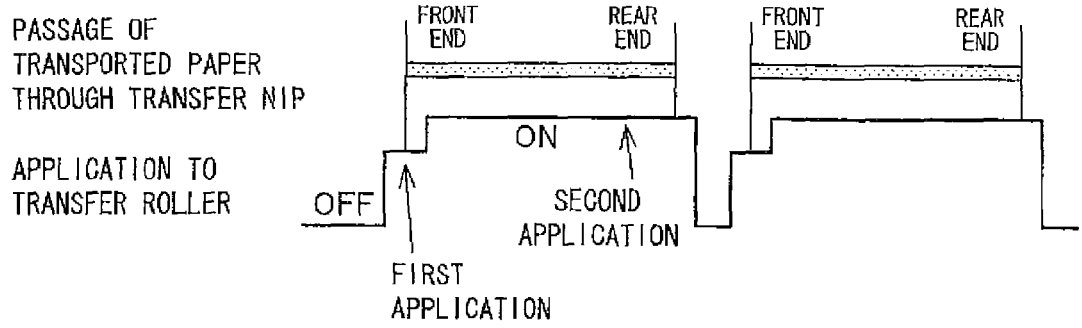
FIGS. 14(*a*) through 14(*c*) represent the passage of printing paper through a transfer nip in relation to applied voltage to the transfer roller, in an image forming apparatus of one embodiment of the present invention.
Figure 14:
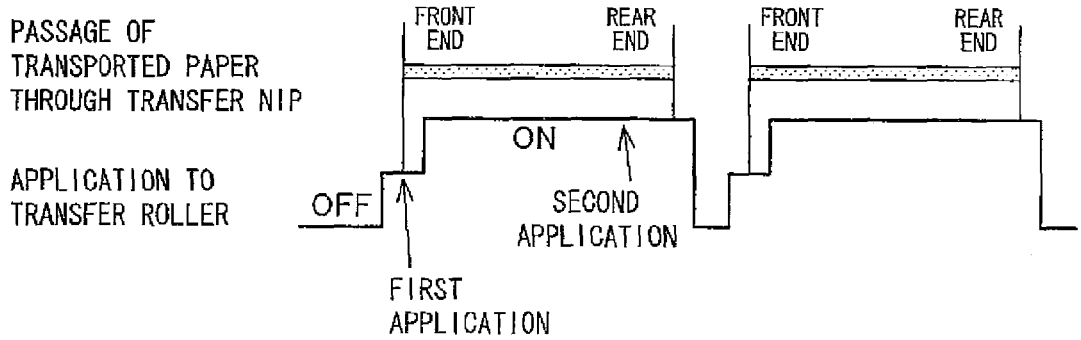
Figure 14:
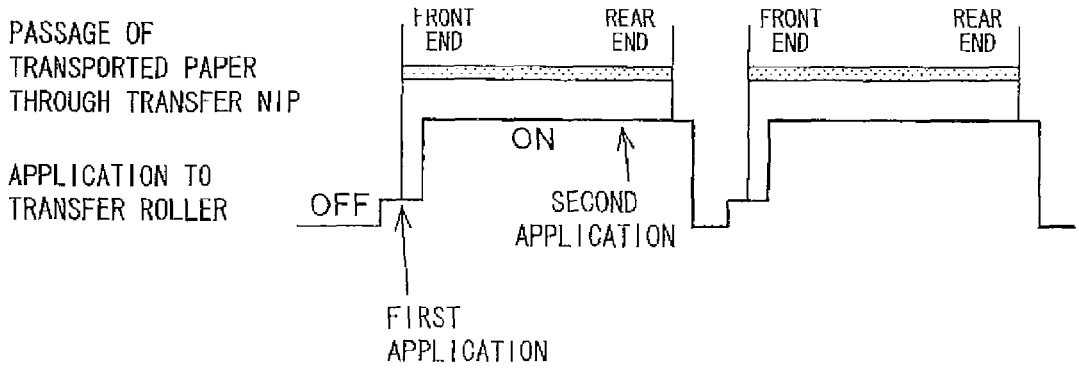

FIGS. 14(*a*) through 14(*c*) represent the passage of printing paper through the transfer nip in relation to applied voltage to the transfer roller 74, in the image forming apparatus 3 of the present embodiment. As shown in FIGS. 14(*a*) through 14(*c*), the transfer electric field control section 100 controls the applied voltage to the transfer roller 74 such that the electric field which the transfer roller 74 applies to the printing paper when the leading edge of the printing paper passes through the transfer nip is weaker than the predetermined transfer electric field suited for transfer (first application). After the leading edge of the printing paper has passed through the transfer nip, the applied voltage to the transfer roller 74 is controlled such that the predetermined transfer electric field suited for transfer is applied to the printing paper by the transfer roller 74 (second application).

More specifically, as shown in FIGS. 14(*a*) through 14(*c*), the first voltage application to the transfer roller 74 is started immediately before the leading edge of the printing paper reaches the transfer nip. When the entire predetermined region, pre-defined as the leading edge of the printing paper has reached the transfer nip portion, a transition is made to the second voltage application and the applied voltage is increased. The second voltage application is retained until the rear end of the printing paper passes through the transfer nip portion, after which the voltage is turned off.

Preferably, the weak electric field is set such that the printing paper that has attached to the photoreceptor 23 under the weak electric field naturally strips off from the photoreceptor 23 according to the transport speed of the printing paper and the curvature of the photoreceptor 23.

By setting the weak electric field in this manner, the printing paper can be prevented from winding around the photoreceptor 23, and the toner contamination at the leading edge of the printing paper can be prevented even more effectively.

The leading edge of printing paper under weak electric field is confined within a void region formed on the periphery of the printing paper and where no toner image is formed. Specifically, the leading edge of printing paper is the region no longer than 3 mm to 5 mm from the front end of the printing paper.

Figure 15:
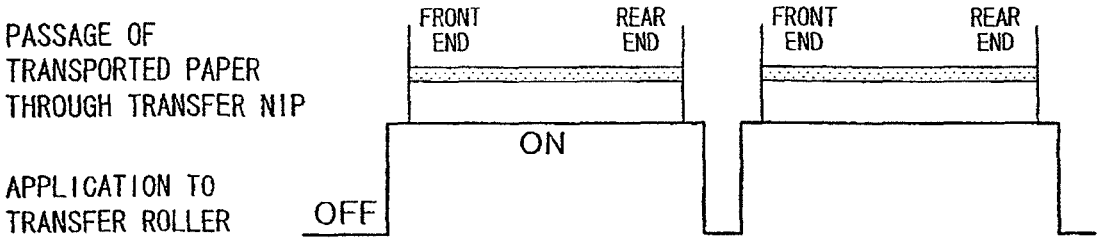
PRIOR ART FIG. 15
FIG. 15 represents the passage of printing paper through a transfer nip in relation to applied voltage to the transfer roller, in a conventional image forming apparatus.

FIG. 15 represents the passage of printing paper through the transfer nip in relation to applied voltage to the transfer roller, in a conventional image forming apparatus. As shown in FIG. 15, the applied voltage is controlled in one step over the entire region of the printing paper, so that the same transfer electric field is applied to the leading edge and the other part of the printing paper. As such, the leading edge of the printing paper is attracted to the photoreceptor with a strong attraction force. Here, if the gap 117 is created by the projection 114 between the transport belt 71 and the leading edge of the printing paper P, the rotation of the photoreceptor 23 causes a continuous discharge between the transport belt 71 and the leading edge of the printing paper P according to Paschen's law. As a result, the printing paper winds around the photoreceptor.

In the present embodiment, the image forming apparatus 3 is adapted to specify types of printing paper, and, according to the thickness of printing paper, switch the electric field used to apply the weak electric field. Referring to FIGS. 14(*a*) to 14(*c*), FIG. 14(*a*) represents the case of a thin printing paper (basis weight $\leqq 80$ g/m$^2$), FIG. 14(*b*) the case of a regular printing paper (80 g/m$^2$<basis weight<128 g/m$^2$), and FIG. 14(*c*) the case of a thick printing paper (basis weight $\geqq 128$ g/m$^2$). By comparing FIGS. 14(*a*) to 14(*c*), it can be seen that it is not the timing of voltage application that is varied according to the thickness of the printing paper, but it is the voltage applied to the transfer roller to apply the weak electric field. Here, the difference between the weak electric field and the transfer electric field is increased with increase in thickness of the printing paper.

This is because, in the present embodiment, the image forming apparatus 3 is a high-speed machine with the peripheral speed of the photoreceptor 23 at 500 to 650 mm/sec. As described above, the influence of the stiffness of printing paper on ease of stripping becomes small as the peripheral speed of the photoreceptor is increased. Further, in reversal development in which a transfer electric field of the opposite polarity to the photoreceptor is applied to the printing paper, the influence of thickness-dependent charge amount is further accentuated and stripping of thick printing paper is more difficult compared with thin printing paper.

As shown in FIG. 13, the transfer electric field control section 100 is adapted to receive a type information signal, indicative of a type of printing paper, from the printing paper type determining section 202. The transfer electric field control section 100 specifies a type of printing paper according to the type information signal it receives, and selects a voltage for applying a weak electric field according to the type of printing paper. The printing paper type determining section 202 may be arranged in various ways. For example, the printing paper type determining section 202 may be arranged to specify a type of printing paper based on a selected tray, in relation to the type of printing paper designated by the tray.

Here, the amount of charge, which varies according to the thickness of printing paper is taken as one of the factors that influence case of stripping. However, the present invention is not limited to this example. The value of weak electric field (voltage value for applying the weak electric field) may be switched according to other factors, except for factors that are intrinsic to and are invariable in the image forming apparatus.

In the case where the power supply circuit section 201 is, for example, a constant current control circuit section that adjusts a voltage applied from a high-voltage source to the transfer roller 74 to provide a predetermined amount of current flow between the transfer roller 74 and the photoreceptor 23, the weak electric field and the transfer electric field are set in the transfer electric field control section 100 as values of current that flows between the transfer roller 74 and the photoreceptor 23.

Table 2 represents current values for applying a weak electric field that is set for each type of printing paper, and current values for applying a transfer electric field common to all types of printing paper, at the peripheral speed of the photoreceptor 23 set to 500 to 650 mm/sec.

TABLE 2

| Peripheral speed of photoreceptor at 500 to 650 mm/sec | | | |
|---|---|---|---|
| | | | Transfer Electric Field (μA) |
| Weak Electric Field | Paper Type | Thin Paper | 25-30 |
| | | Regular Paper | 20-25 |
| | | Thick Paper | 15-20 |
| Transfer Electric Field | | All Papers | 50-60 |

Here, three types of printing paper, thin, regular, and thick, are considered. The weak electric field for the thick printing paper, which is most susceptible to electrification, is set to 15 to 20 μA, which is the weakest among the three types of printing paper. The weak electric field is 20 to 25 μA for the regular paper, and 25 to 30 μA for the thin paper. The transfer electric field common to all three types of printing paper is set to 50 to 60 μA.

Apparently, the transfer electric field is determined not only by the peripheral speed but by other factors as well, such as the diameter of the photoreceptor 23, the thickness of the printing paper, and the width of the transfer nip. It has been confirmed that the foregoing ranges of transfer electric field are indeed suitable when the peripheral speed of the photoreceptor 23 is 500 to 650 mm/sec, and when the diameter of the photoreceptor 23 is 80 to 150 mm, through slight variations are possible depending on different models.

Table 3 represents current values for applying a weak electric field that is set for each type of printing paper, and current values for applying a transfer electric field common to all types of printing paper, at the peripheral speed of the photoreceptor 23 set to 300 to 450 mm/sec. Three types of printing paper, thin, regular, thick were also used in this example.

TABLE 3

| Peripheral speed of photoreceptor at 300 to 450 mm/sec | | | |
|---|---|---|---|
| | | | Transfer Electric Field (μA) |
| Weak Electric Field | Paper Type | Thin Paper | 10-15 |
| | | Regular Paper | 15-20 |

TABLE 3-continued

| Peripheral speed of photoreceptor at 300 to 450 mm/sec | | |
|---|---|---|
| | | Transfer Electric Field (μA) |
| | Thick Paper | 20-25 |
| Transfer Electric Field | All Papers | 30-45 |

In Table 3, contrary to the high-speed machine represented in Table 2, the weak electric field is weakest at 10 to 15 μA for the thin printing paper, 15 to 20 μA for the regular printing paper, and 20 to 25 μA for the thick printing paper. The common transfer electric field is set at 30 to 45 μA. The weak electric field is weakest for the thin printing paper because, when the peripheral speed of the photoreceptor 23 is 300 to 450 mm/sec, ease of stripping is influenced more by the amount of charge than the stiffness of printing paper, both of which vary depending on the thickness of printing paper.

The transfer electric field is greater than the values shown in Table 2 for the high-speed machine, because the slower peripheral speed of the photoreceptor 23 provides a longer passage time for the printing paper to pass through the transfer nip. As in the case of Table 2, it has been confirmed that the foregoing ranges of transfer electric field are indeed suitable when the peripheral speed of the photoreceptor 23 is 300 to 450 mm/sec, and when the diameter of the photoreceptor 23 is 30 to 60 mm, through slight variations are possible depending on different models.

In the case where the power supply circuit section 201 is, for example, a constant voltage control circuit section that adjusts a voltage applied from a high-voltage source to the transfer roller 74 to apply a preset voltage to the transfer roller 74, the weak electric field and the transfer electric field are set in the transfer electric field control section 100 as values of voltage applied to the transfer roller 74.

Further, in the present embodiment, the image forming apparatus 3 is adapted to find the presence or absence of a void, which is a region at the leading edge of printing paper where no image is formed, and, when there is no void, i.e., when the toner image is transferred to the entire region of the printing paper including the leading edge, perform the conventional control of applying the transfer electric field over the entire region of the printing paper, without applying a weak electric field to the leading edge.

In this way, the transfer electric field suited for transfer is also applied to the leading edge and the toner image is transferred. There accordingly will be no adverse effect on the image at the leading edge of the printing paper. In the case where the leading edge of printing paper has image information and the toner image is transferred, the charged potential at the leading edge is reduced by the toner that has attached to this region of the printing paper. This reduces the attraction force between the printing paper and the photoreceptor 23, making it difficult for the printing paper to wind around the photoreceptor 23.

As shown in FIG. 13, the transfer electric field control section 100 receives void information signal, supplied from a void determining section 203 and indicative of whether or not image information is present at the leading edge of the printing paper. In the case where the void information signal indicates that a void is present at the leading edge of the printing paper, the transfer electric field control section 100 does not select a voltage for applying a weak electric field, but selects a voltage for applying the transfer electric field, also for the leading edge of the printing paper.

As described above, in order to prevent toner contamination caused by the stripping claw that comes in contact with the leading edge of the printing paper due to the projection that prevents the printing paper from being naturally stripped off from the surface of the photoreceptor, the present invention provides an image forming apparatus in which an electrostatic latent image formed on a surface of a photoreceptor is developed into a toner image with a developing device, and in which a printing paper transported on a transport belt is brought into contact with the surface of the photoreceptor and an electric field is applied to the printing paper from a rear surface of the transport belt by a transfer roller so as to transfer the toner image onto the printing paper, the transfer roller capable of applying different levels of electric field to the printing paper, so that a predetermined transfer electric field is applied to a region other than a leading edge of the printing paper being transported, and that a weak electric field weaker than the predetermined transfer electric field is applied to the leading edge of the printing paper being transported.

By weakening the transfer electric field applied to the leading edge of the printing paper, the attraction force between the printing paper and the photoreceptor can be reduced at the leading edge. When the photoreceptor rotates, this causes a continuous discharge according to Paschen's law between the leading edge of the printing paper and the photoreceptor, even when the projection is present at the leading edge of the printing paper and when it creates a gap between the transfer belt and the leading edge of the printing paper. As a result, ease of stripping of the printing paper from the photoreceptor is improved, and toner contamination at the leading edge of the printing paper can be effectively prevented.

In an image forming apparatus of the present invention, it is preferable that the weak electric field be set such that it allows the printing paper to naturally strip from the photoreceptor according to a transport speed of the printing paper and curvature of the photoreceptor, when the printing paper adheres to the photoreceptor under the weak electric field.

By setting the weak electric field this way, winding of the printing paper around the photoreceptor in the transfer step can be effectively prevented, and toner contamination at the leading edge of the printing paper can be prevented more effectively.

In an image forming apparatus of the present invention, it is preferable that the weak electric field be varied according to types of the printing paper.

Among many factors that determine ease of stripping of the printing paper from the photoreceptor, the stiffness or strength of the printing paper has the greatest influence. By switching the weak electric field according to the type of printing paper, winding of the printing paper around the photoreceptor in the transfer step can be prevented even more effectively.

When the peripheral speed of the photoreceptor is equal to or greater than 500 mm/sec, the amount of charge by the applied electric field of the transfer roller has the stronger influence than the stiffness of the printing paper. Thus, by setting a weaker electric field for thick printing paper than for thin printing paper, winding of the printing paper around the photoreceptor in the transfer step can be effectively prevented also in high-speed machines.

An image forming apparatus of the present invention may be adapted to include a determining section for determining the presence or absence of a transferred image at the leading edge of the printing paper being transported, wherein the transfer roller applies the predetermined transfer electric field also to the leading edge of the printing paper being transported, when the leading edge of the printing paper has the transferred image as determined by the determining section.

According to this arrangement, the transfer roller applies the predetermined transfer electric field, not the weak electric field, also to the leading edge of the printing paper, when the leading edge of the printing paper has the transferred image as determined by the determining section, i.e., when there is no void at the leading edge.

There accordingly will be no adverse effects on the image at the leading edge of the printing paper. Further, when image information is present also on the leading edge of the printing paper and the toner image is transferred, the toner weakens the charged potential at the leading edge and the attraction force between this part of the printing paper and the photoreceptor is reduced. This suppresses winding of the printing paper.

In order to achieve the foregoing object, the present invention provides a transfer device in which a printing paper transported on a transport belt is brought into contact with a surface of a photoreceptor and an electric field is applied to the printing paper from a rear surface of the transport belt by a transfer roller so as to transfer a toner image formed on the surface of the photoreceptor onto the printing paper, the transfer roller capable of applying different levels of electric field to the printing paper, so that a predetermined transfer electric field is applied to a region other than a leading edge of the printing paper being transported, and that a weak electric field weaker than the predetermined transfer electric field is applied to the leading edge of the printing paper being transported.

In order to achieve the foregoing object, the present invention provides an image forming method in which an electrostatic latent image formed on a surface of a photoreceptor is developed into a toner image with a developer, and in which a printing paper transported on a transport belt is brought into contact with the surface of the photoreceptor and an electric field is applied to the printing paper from a rear surface of the transport belt by a transfer roller so as to transfer the toner image onto the printing paper, the method including weakening an electric field that is applied to a leading edge of the printing paper being transported, relative to an electric field applied to a region of the printing paper other than the leading edge.

By installing a transfer device of the present invention in an image forming apparatus, and by applying an image forming method of the present invention to an image forming apparatus, it is possible to obtain the effects described as effects of an image forming apparatus of the present invention.

That is, it is possible to realize an image forming apparatus, an image forming method, and a transfer device in which the printing paper naturally strips off from the surface of the photoreceptor without the aid of the stripping claw, and in which toner contamination caused by the stripping claw in contact with the leading edge of the printing paper can be prevented.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

What is claimed is:

1. An image forming apparatus, in which an electrostatic latent image formed on a surface of a photoreceptor is developed into a toner image with a developing device, and in which a printing paper transported on a transport belt is brought into contact with the surface of the photoreceptor and an electric field is applied to the printing paper from a rear surface of the transport belt by a transfer roller to transfer the toner image onto the printing paper, the transfer roller applying different levels of electric field to the printing paper, so that a predetermined transfer electric field is applied to a region other than a leading edge of the printing paper being transported, and that a weak electric field weaker than the predetermined transfer electric field is applied to the leading edge of the printing paper being transported, the weak electric field being set so that the printing paper naturally strips from the photoreceptor according to a transfer speed of the printing paper and curvature of the photoreceptor even in a case where the printing paper has a projection that is formed when the printing paper is cut and where the projection is formed at the leading edge of the printing paper and faces the transport belt, wherein the weak electric field is varied according to types of the printing paper, and wherein the weak electric field is weaker for a thick printing paper than for a thin printing paper, when a peripheral speed of the photoreceptor is equal to or greater than 500 mm/sec.

2. The image forming apparatus as set forth in claim 1, further comprising:

a determining section for determining the presence or absence of image information at the leading edge of the printing paper being transported, wherein the transfer roller applies the predetermined transfer electric field also to the leading edge of the printing paper being transported, when the leading edge of the printing paper has the transferred image as determined by the determining section.

3. A transfer device in which a printing paper transported on a transport belt is brought into contact with a surface of a photoreceptor and an electric field is applied to the printing paper from a rear surface of the transport belt by a transfer roller to transfer a toner image formed on the surface of the photoreceptor onto the printing paper, the transfer roller capable of applying different levels of electric field to the printing paper, so that a predetermined transfer electric field is applied to a region other than a leading edge of the printing paper being transported, and that a weak electric field weaker than the predetermined transfer electric field is applied to the leading edge of the printing paper being transported, the weak electric field being set so that the printing paper naturally strips from the photoreceptor according to a transfer speed of the printing paper and curvature of the photoreceptor even in a case where the printing paper has a projection that is formed when the printing paper is cut and where the projection is formed at the leading edge of the printing paper and faces the transport belt, wherein the weak electric field is varied according to types of the printing paper, and wherein the weak electric field is weaker for a thick printing paper than for a thin printing paper, when a peripheral speed of the photoreceptor is equal to or greater than 500 mm/sec.

4. An image forming method in which an electrostatic latent image formed on a surface of a photoreceptor is developed into a toner image with a developer, and in which a printing paper transported on a transport belt is brought into contact with the surface of the photoreceptor and an electric field is applied to the printing paper from a rear surface of the transport belt by a transfer roller to transfer the toner image onto the printing paper, the method comprising:

weakening an electric field that is applied to a leading edge of the printing paper being transported, relative to an electric field applied to a region of the printing paper other than the leading edge, the weakened electric field being set so that the printing paper naturally strips from the photoreceptor according to a transfer speed of the printing paper and curvature of the photoreceptor even in a case where the printing paper has a projection that is formed when the printing paper is cut and where the projection is formed at the leading edge of the printing paper and faces the transport belt having a value of preventing the leading edge of the printing paper from being attached to the photoreceptor wherein the weakened electric field is varied according to types of the printing paper, and wherein the weakened electric field is weaker for a thick printing paper than for a thin printing paper, when a peripheral speed of the photoreceptor is equal to or greater than 500 mm/sec.

* * * * *